US005644842A

United States Patent [19]

Coleman

[11] Patent Number: 5,644,842

[45] Date of Patent: Jul. 8, 1997

[54] METHOD OF MAKING PROFILED TUBE AND SHELL HEAT EXCHANGERS

[76] Inventor: Rick L. Coleman, 1095 Warwick Cir. S., Hoffman Estates, Ill. 60194

[21] Appl. No.: 369,086

[22] Filed: Jan. 5, 1995

[51] Int. Cl.[6] ..... B23P 15/00

[52] U.S. Cl. ..... 29/890.053; 29/890.044

[58] Field of Search ..... 29/890.043, 890.044, 29/890.053

[56] References Cited

U.S. PATENT DOCUMENTS

| | | | |
|---|---|---|---|
| 3,196,657 | 7/1965 | Fromson | 29/890.053 |
| 4,031,745 | 6/1977 | McCarty | 29/890.053 |
| 4,546,824 | 10/1985 | Melnyk | 165/175 |
| 4,744,505 | 5/1988 | Calleson | 165/173 |
| 5,099,576 | 3/1992 | Shinmura | 29/890.053 |
| 5,214,848 | 6/1993 | Lelieure | 29/890.053 |

*Primary Examiner*—Irene Cuda
*Attorney, Agent, or Firm*—Neal J. Mosely

[57] ABSTRACT

A method is disclosed for producing heat exchange tubing for use in tube and shell heat exchangers hag proved heat exchange and proved fluid flow around the heat exchange tubes in which cylindrical tubing is deformed by pressure rollers to produce tubes having cylindrical ends and intermediate potions of elliptical cross section. These tubes may also be bent to U-shaped heat exchange tubes. The cylindrical end portions on one end are secured in a tube sheet, and the elliptical intermediate portions extend through baffle plates having openings sized according to TEMA standards. The assembly is secured a shell having inlet and outlet openings on the same side or opposite sides of the shell and a second be sheet fitted over the other cylindrical ends of the heat exchange tubes, dished headers are secured over each of the tube sheets providing an inlet/outlet header at one end and a fluid return header at the other end. In another embodiment, the heat exchange tubes have cylindrical ends and a first intermediate portion deformed by pressure rollers to a first elliptical cross section and a second intermediate portion deformed by pressure rollers to a second elliptical cross section having its major axis at a substantial angle to the major axis of the first elliptical cross section, the assembly is placed inside a shell having inlet an outlet openings spaced apart on the shell and aligned with the major axes of the respective elliptical sections.

20 Claims, 5 Drawing Sheets

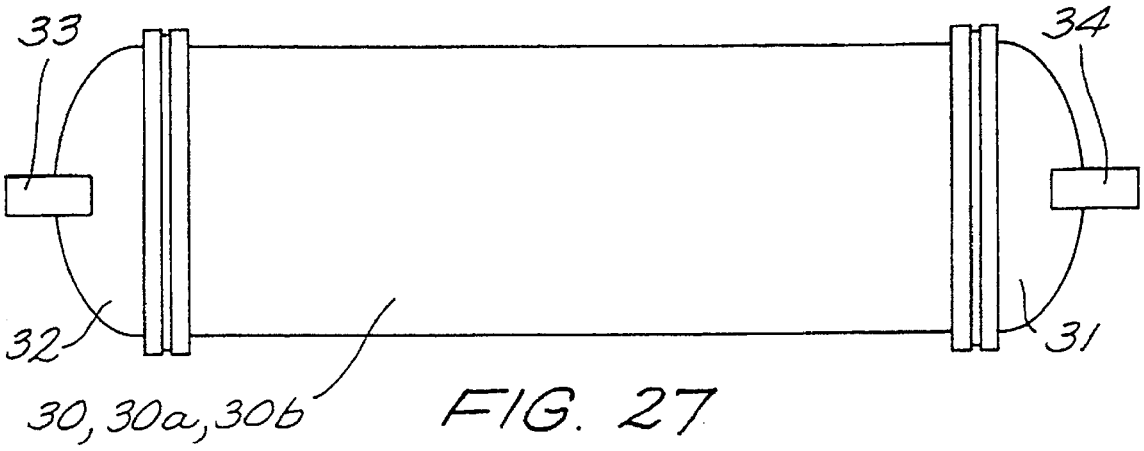
FIG. 27
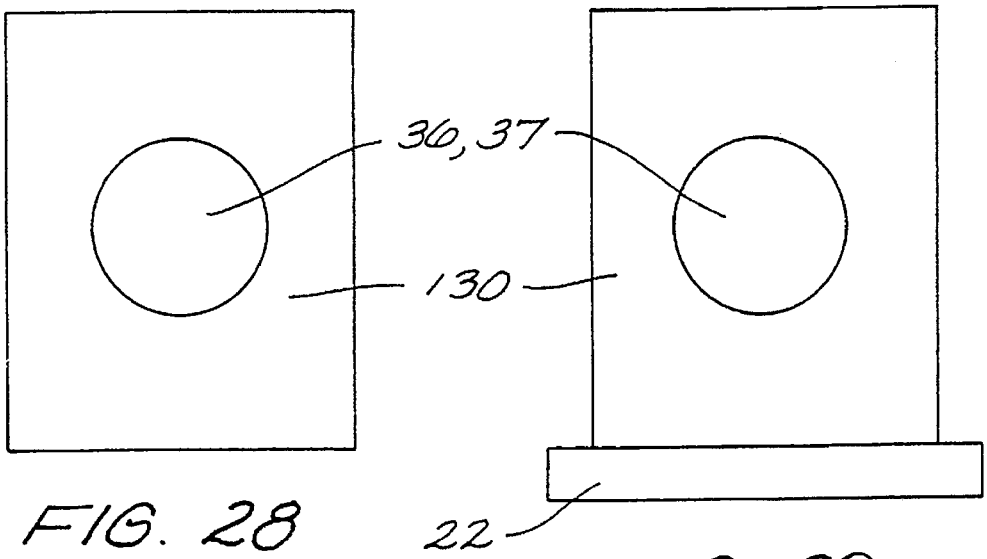
FIG. 28
FIG. 29

METHOD OF MAKING PROFILED TUBE AND SHELL HEAT EXCHANGERS

FIELD OF THE INVENTION

This invention relates to new and useful improvements in manufacturing profiled heat exchange tubing and assembly of tube and shell heat exchangers therefrom.

BRIEF DESCRIPTION OF THE PRIOR ART

Tube and shell heat exchangers have been in use for many years. There have been many efforts to improve such heat exchangers. One effort in improving heat exchangers has involved the use of profiled heat exchange tubing.

Armbruster et al U.S. Pat. No. 5,154,225 discloses soldered disk oil coolers made using two disk plate which are stacked on one another for forming a hollow body, and are connected by soldering their outer edges. The individual disk bodies are constructed of two plates of a circular or elliptic shape in such a manner that their edges overlap one another and are in this case adapted to one another such that the outer edge is lockingly and under tension held at the inner edge of the other plate.

Grieb et al U.S. Pat. 4,766,953 discloses a shaped tube with an elliptical cross-section with a multichamber design for tubular heat exchangers having at least two cross ribs passing through an interior space of the tube at a distance from one another. A method for making this tube provides for bending an endless metal strip into two semifinished products with congruent profiles. Each profile has the shape of an isosceles triangle with rounded vertices and an elongated leg. The semifinished products are then placed against one another so that the free end of the elongated leg of one semifinished product abuts the triangle base edge of the other semifinished product.

Hagemeister U.S. Pat. No. 4,577,684 discloses a heat exchanger comprising a profiled tubes arranged in vertical columns and horizontal rows, each profiled tube being of oblong shape and, at least in part, surrounded by at least two supporting profile strips extending in the direction of fluid flow. The profiled strips of adjacent profiled tubes in a column are held at their ends in a well defined position. Furthermore, the profile strips can rest directly or indirectly on other profile strips, adjacent thereto at the left or right, of adjacent profiled tubes. In this way, individual profiled tubes are longitudinally displaceable in an exact field arrangement and can compensate for changes in length.

Juger U.S. Pat. No. 5,329,988 discloses a heat exchanger core having a pair of header plates having a plurality of openings therein, a plurality of oval cross-section heat exchanger tubes adapted to receive a fluid medium therethrough extending in generally spaced parallel relationship between the header plates, the ratio between the major diameter and the minor diameter of each of the tubes being from about 12/1 to about 18/1, each of the plurality of tubes being positioned and arranged such that the ends of each of the tubes are joined to corresponding openings in each of the header plates to form a plurality of tube-to-header joints, and a plurality of louvered serpentine heat transfer fin elements disposed between the header plates in a heat exchange relationship with the plurality of tubes.

Abraham U.S. Pat. No. 5,123,482 discloses a heat exchanger having two plastic seal plates are located between the end of a manifold and the end of the heat exchanger core having oval shaped flow tubes extending through parallel fins. One seal plate has a plurality of spaced apart oval shaped apertures formed therethrough located to tightly receive the ends of the flow tubes. Oval shaped extension tubes extend from one side of the one seal plate from the oval shaped apertures for tightly receiving the ends of the flow tubes. The other seal plate has a plurality of oval shaped apertures formed therethrough for tightly receiving the extension tubes.

Diesch U.S. Pat. No. 5,094,224 discloses an enhanced tubular beat exchanger in which the tubes include an enhanced portion which has a smaller cross-section in the form of an elliptically shaped tube. A plurality of tubes are disposed within the heat exchanger so that the circulation air first flows over the enhanced portions then over and around the generally cylindrical portions. This lowers the initial pressure drop in the circulation air flow and thereby facilitates the circulation of and heat transfer to the air being heated.

Merrill et al U.S. Pat. No. 4,755,331 discloses a coil assembly for use in an evaporative parallel flow or counterflow heat exchanger in which the heat exchanger comprises a conduit oriented in a vertical direction through which external heat exchange fluids flow in a generally vertical direction, the coil assembly being mountable within the conduit, the coil assembly comprising inlet and outlet manifolds and a plurality of tubes connecting the manifolds, the tubes including bights and segments extending generally horizontally across the conduit and connected to at least one bight, the bights being oriented vertically and connecting segments of the tube at different levels within the conduit, the bights of adjacent tubes being in contact with each other, the segments having a generally elliptical cross sectional shape such that the segments of adjacent tubes are spaced from each other in a direction generally normal to the flow direction. The elliptical segments may be angled in the same or opposition directions as long as the spacing is maintained between the segments of adjacent tubes. The bights may have a circular or elliptical cross section.

Potier U.S. Pat. No. 4,682,650 a tube-bank heat exchanger which is primarily intended for use in automotive vehicles and comprises tube sheets or headers having holes for mounting the tube ends in a fluid-tight manner, predetermined tubes are provided at each end with a flared-out end portion located externally of each header while other predetermined tubes are provided at each end with an annular bulge located internally of each header in order to ensure that the headers are maintained in rigidly Fixed relation, thus preventing any displacement with respect to the longitudinal axis of the tubes.

These heat exchangers, however, do not disclose elliptical or oval heat exchange tubes having cylindrical ends for fitting in tube sheets or manifolds, or tubes having a plurality of elliptical or oval portions having their major axes extending at an angle to each other or a method of manufacturing such tubes and assembling them into a heat exchanger.

SUMMARY OF THE INVENTION

One of the objects of this invention is to provide a new and improved method for producing heat exchange tubing for use in tube and shell heat exchangers having improved heat exchange and improved fluid flow around the heat exchange tubes.

Another object of this invention is to provide a new and improved method for producing heat exchange tubing for use in tube and shell heat exchangers having improved heat exchange and improved fluid flow around the heat exchange tubes in which the heat exchange tubes have cylindrical ends and an intermediate portion deformed by pressure rollers to an elliptical cross section.

Another object of this invention is to provide a new and improved method for producing heat exchange tubing for use in tube and shell heat exchangers having improved heat exchange and improved fluid flow around the heat exchange tubes in which the heat exchange tubes have cylindrical ends and two intermediate portions deformed by pressure rollers to separate elliptical cross sections having their major axes displaced at a substantial angle one from the other.

Another object of this invention is to provide a new and improved method for producing heat exchange tubing for use in tube and shell heat exchangers having improved heat exchange and improved fluid flow around the heat exchange tubes in which the heat exchange tubes have cylindrical ends and an intermediate portion deformed by pressure rollers to an elliptical cross section in which baffle plates having openings sized according to TEMA standards are supported on spacer rods, and heat exchange tubes which have cylindrical ends and an intermediate portion deformed by pressure rollers to an elliptical cross section are passed through the openings in the baffle plates so that one set of cylindrical tube ends are secured in the holes in one tube sheet and the elliptical intermediate portions are supported in the holes in the baffle plates and a second tube sheet fitted over the other cylindrical ends of the tubes.

Another object of this invention is to provide a new and improved method for producing heat exchange tubing for use in tube and shell heat exchangers having improved heat exchange and improved fluid flow around the heat exchange tubes in which the heat exchange tubes have cylindrical ends and a first intermediate portion deformed by pressure rollers to a first elliptical cross section and a second intermediate portion deformed by pressure rollers to a second elliptical cross section having its major axis at a substantial angle to the major axis of the first elliptical cross section in which baffle plates having openings sized according to TEMA standards are supported on spacer rods, and the heat exchange tubes have cylindrical ends and a first intermediate elliptical portion passed through the openings in the baffle plates so that one set of cylindrical tube ends are secured in the holes in one tube sheet and the elliptical intermediate portions are supported in the holes in the baffle plates and a tube sheet fitted over the other cylindrical ends of the tubes.

Still another object of this invention is to provide a new and improved method for producing heat exchange tubing for use in tube and shell heat exchangers having improved heat exchange and improved fluid flow around the heat exchange tubes in which the heat exchange tubes have cylindrical ends and an intermediate portion deformed by pressure rollers to an elliptical cross section in which baffle plates having openings sized according to TEMA standards are supported on spacer rods, and the heat exchange tubes have cylindrical ends and an intermediate elliptical portion passed through the openings in the baffle plates so that one set of cylindrical tube ends are secured in the holes in one tube sheet and the intermediate portions are supported in the holes in the baffle plates and the assembly secured in a shell having inlet and outlet openings on the same side of the shell, the other ends of the tubes fitting into holes in a second tube sheet and the tube sheets fired tightly on opposite ends of a heat exchange shell.

Still another object of this invention is to provide a new and improved method for producing heat exchange tubing for use in tube and shell heat exchangers having improved heat exchange and improved fluid flow around the heat exchange tubes in which the heat exchange tubes have cylindrical ends and an intermediate portion deformed by pressure rollers to an elliptical cross section in which baffle plates having openings sized according to TEMA standards are supported on spacer rods, and the heat exchange tubes have cylindrical ends and an intermediate elliptical portion passed through the openings in the baffle plates so that one set of cylindrical tube ends are secured in the holes in one tube sheet and the intermediate portions are supported in the holes in the baffle plates and the assembly secured in a shell having inlet and outlet openings on opposite sides of the shell, the other ends of the tubes firing into holes in a second tube sheet and the tube sheets fired tightly on opposite ends of the heat exchange shell.

Still another object of this invention is to provide a new and improved method for producing heat exchange tubing for use in tube and shell heat exchangers having improved heat exchange and improved fluid flow around the heat exchange tubes in which the heat exchange tubes have cylindrical ends and a first intermediate portion deformed by pressure rollers to a first elliptical cross section and a second intermediate portion deformed by pressure rollers to a second elliptical cross section having its major axis at a substantial angle to the major axis of the first elliptical cross section in which baffle plates having openings sized according to TEMA standards are supported on spacer rods, and the heat exchange tubes have cylindrical ends and a first intermediate elliptical portion passed through the openings in the baffle plates so that one set of cylindrical tube ends are secured in the holes in one tube sheet and the first elliptical intermediate portions are supported in the holes in the baffle plates and the assembly secured in a shell having inlet and outlet openings displaced angularly on the shell, and the other ends of the tubes firing into holes in a second tube sheet and the tube sheets fired tightly on the opposite ends of the heat exchange shell.

Still another object of this invention is to provide a new and improved method for producing heat exchange tubing for use in tube and shell heat exchangers having improved heat exchange and improved fluid flow around the heat exchange tubes in which the heat exchange tubes have cylindrical ends and an intermediate portion deformed by pressure rollers to an elliptical cross section in which baffle plates having openings sized according to TEMA standards are supported on spacer rods, and the heat exchange tubes have cylindrical ends and an intermediate elliptical portion passed through the openings in the baffle plates so that one set of cylindrical tube ends are secured in the holes in one tube sheet and the intermediate portions are supported in the holes in the baffle plates and the assembly secured in a shell having inlet and outlet openings on the same side of the shell, the other ends of the tubes fitting into holes in a second tube sheet and the tube sheets fired tightly on opposite ends of a heat exchange shell and headers secured over each of the tube sheets providing an inlet/outlet header at one end and a fluid return header at the other end.

Still another object of this invention is to provide a new and improved method for producing heat exchange tubing for use in tube and shell heat exchangers having improved heat exchange and improved fluid flow around the heat exchange tubes in which the heat exchange tubes have cylindrical ends and an intermediate portion deformed by pressure rollers to an elliptical cross section in which baffle plates having openings sized according to TEMA standards are supported on spacer rods, and the heat exchange tubes have cylindrical ends and an intermediate elliptical portion passed through the openings in the baffle plates so that one set of cylindrical tube ends are secured in the holes in one tube sheet and the intermediate portions are supported in the holes in the baffle plates and the assembly secured in a shell having inlet and outlet openings on the same side of the shell, the other ends of the tubes firing into holes in a second tube sheet and the tube sheets fired tightly on opposite ends of a heat exchange shell and closure members secured over each of the tube sheets providing an inlet header at one end and an outlet at the other end.

Still another object of this invention is to provide a new and improved method for producing heat exchange tubing for use in tube and shell heat exchangers having improved heat exchange and improved fluid flow around the heat exchange tubes in which the heat exchange tubes have cylindrical ends and an intermediate portion deformed by pressure rollers to an elliptical cross section in which a first set of baffle plates having openings sized according to TEMA standards are supported on spacer rods, and the heat exchange tubes have cylindrical ends and an intermediate elliptical portion passed through the openings in the baffle plates so that one set of cylindrical tube ends are secured in the holes in one tube sheet and the intermediate portions are supported in the holes in the baffle plates and the assembly secured in a shell having inlet and outlet openings on opposite sides of the shell, the other ends of the tubes fitting into holes in a second tube sheet and the tube sheets fitted tightly on opposite ends of the heat exchange shell and headers secured over each of the tube sheets providing an inlet/outlet header at one end and a fluid return header at the other end.

Still another object of this invention is to provide a new and improved method for producing heat exchange tubing for use in tube and shell heat exchangers having improved heat exchange and improved fluid flow around the heat exchange tubes in which the heat exchange tubes have cylindrical ends and a first intermediate portion deformed by pressure rollers to a first elliptical cross section and a second intermediate portion deformed by pressure rollers to a second elliptical cross section having its major axis at a substantial angle to the major axis of the first elliptical cross section in which baffle plates having openings sized according to TEMA standards are supported on spacer rods, and the heat exchange tubes have cylindrical ends and a first intermediate elliptical portion passed through the openings in the baffle plates so that one set of cylindrical tube ends are secured in the holes in one tube sheet and the first elliptical intermediate portions are supported in the holes in the baffle plates and the assembly secured in a shell having inlet and outlet openings displaced angularly on the shell, the other ends of the tubes firing into holes in a second tube sheet and the tube sheets fired tightly on opposite ends of the heat exchange shell and headers secured over each of the tube sheets providing an inlet/outlet header at one end and a fluid return header at the other end.

Other objects of the invention will become apparent from time to time throughout the specification and claims as hereinafter related.

BRIEF DESCRIPTION OF THE DRAWINGS

FIG. 27 is a view in elevation of an assembled tube and shell heat exchanger having an inlet at one end of the shell and an outlet at the other end.

FIG. 28 shows an alternate method of construction where a short section of shell is used and the remainder of the shell welded thereon at a subsequent step in the assembly.

FIG. 29 shows an alternate method of construction where a short section of shell is used as in FIG. 28 and showing the connection to one of the tube sheets.

DESCRIPTION OF ONE PREFERRED EMBODIMENT

This invention relates to new and useful improvements in methods and apparatus for producing heat exchange tubes having a profile producing a higher surface area to internal flow ratio for improved efficiency in tube and shell heat exchangers and in improved tube and shell heat exchangers produced therefrom. The method involves deforming a cylindrical heat exchange tube in an intermediate portion to produce a tube having cylindrical (circular cross section) ends and an elliptical cross section mid portion. The tubes are assembled with supporting tube sheets at both ends and baffle plates along the elliptical mid portions and placed in a shell having dished end headers.

Figure 1:
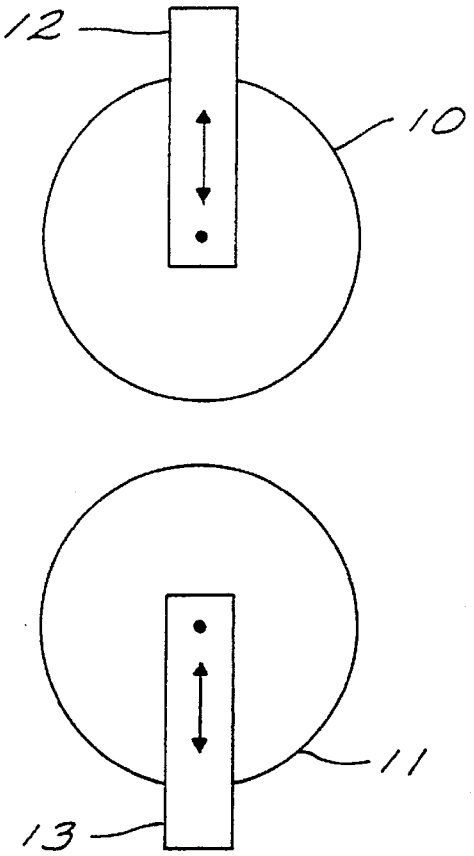
FIG. 1 is a front elevation of tube-forming rolls for use in producing heat exchange tubing having an elliptical cross section according to a preferred embodiment of the invention.
Figure 2:
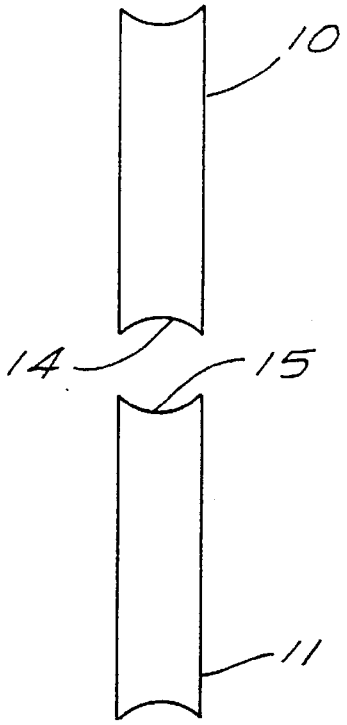
FIG. 2 is a view in side elevation of the tube-forming rolls shown in FIG. 1.
Figure 3:
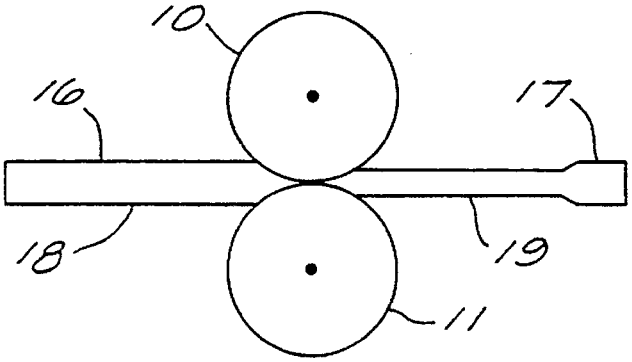
FIG. 3 is a view, in elevation, of a cylindrical tube in the process of being deformed to elliptical cross section by the tube-forming rolls shown in FIGS. 1 and 2.

In FIGS. 1 and 2, there are shown front and side elevations of forming rolls 10 and 11 supported on vertically extending and vertically/reciprocally movable support members 12 and 13. Rolls 10 and 11 have curved surfaces 14 and 15 which are engageable with a tube for deforming its shape as required herein.

Figure 7:
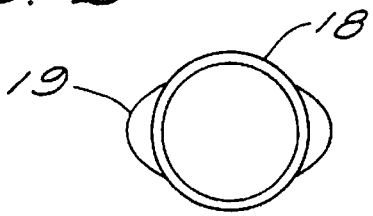
FIG. 7 is an end view of the tube shown in FIG. 4 showing the protrusion of the elliptical intermediate portion.
Figure 6:
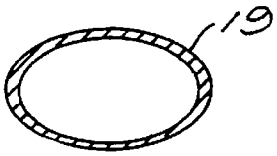
FIG. 6 is a view in cross section taken on the line 6—6 of FIG. 4 or FIG. 8 of the elliptical portion of the tube.

In the first step of this method, a tube 16 of a suitable heat exchange material, such as steel, stainless steel, copper, copper alloys, bronze, brass aluminum or plastic, having an initial cylindrical shape (circular cross section) is contacted by rolls 10 and 11 under pressure to deform the tubing to a form having cylindrical ends (circular cross section) 17 and 18 and an elliptical cross section intermediate portion 19. In carrying out this step, rollers 10 and 11 are contacted with tube under pressure to deform the intermediate portion 19 to an elliptical cross section (see FIGS. 6 and 7) and moved relative to the tube (or the tube drawn or pushed through the rollers) and separated just short of the other end of the tube to produce the tube 16 of FIG. 4 having cylindrical (circular) ends 17 and 18 and an elliptical cross section intermediate portion 19. As used throughout this specification and claims, the term "moving the rollers relative to the tube" is defined to mean moving the rollers along the tube or drawing or pushing the tube through the rollers or operating the rollers under power to draw the tube through the rollers. This procedure may be carried out adjacent to the place of assembly of the heat exchanger or may be carried out at another location where the finished tubes may be stored and subsequently released for use in the assembly.

Figure 8:
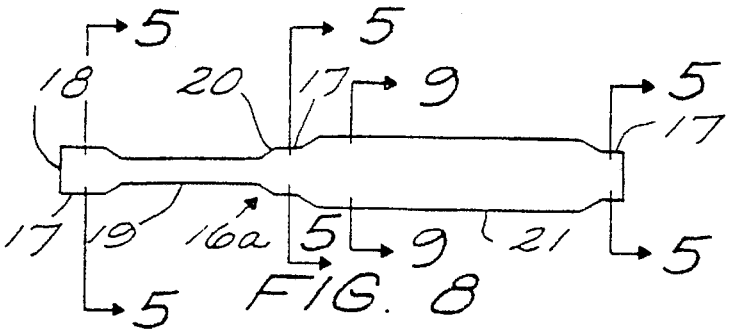
FIG. 8 is a view in elevation of a tube having cylindrical ends and separate intermediate portions of elliptical cross section having their major axes at a substantial angle to each other produced according to the process of FIG. 3.
Figure 9:
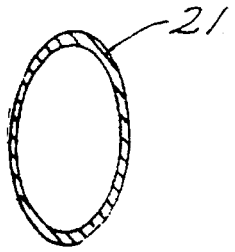
FIG. 9 is a view in cross section taken on the line 9—9 of FIG. 8 showing an intermediate portion of elliptical cross section having its major axis at a right angle to the major axis of the intermediate portion shown in FIG. 6.
Figure 11:
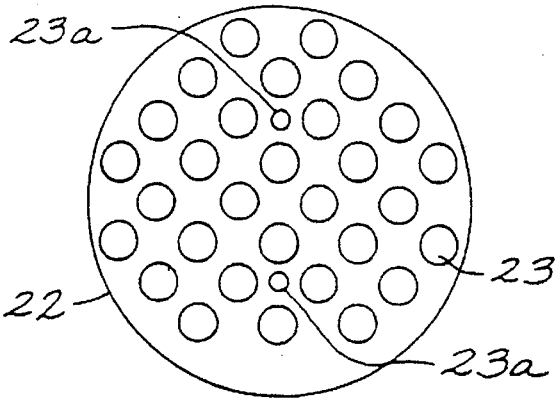
FIG. 11 is a plan view of a tube sheet for receiving and securing the cylindrical ends of the heat exchange tubing.
Figure 12:
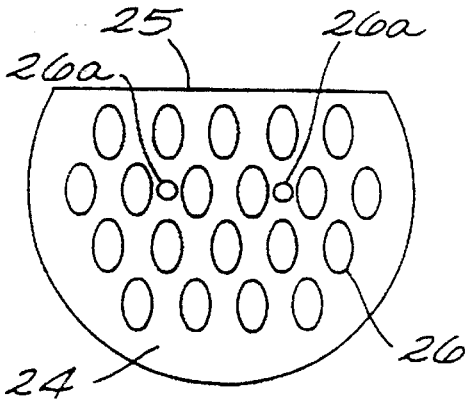
FIG. 12 is a plan view of a tube baffle plate for receiving and securing the elliptical intermediate portions of the heat exchange tubing.
Figure 10:
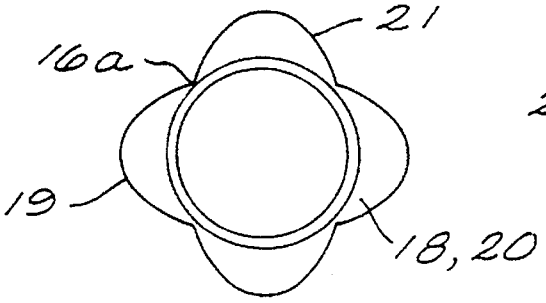
FIG. 10 is an end view of the tube shown in FIG. 8 showing the protrusions of the elliptical intermediate portions.

In an alternate embodiment of tube formation (see FIG. 8), tube **16*a* is deformed for part of its length, e.g. about three-fourths the length, the deforming rolls 10 and 11 released and the tube rotated about 90° and the rollers 10 and 11 then compressed to produce a second intermediate portion of elliptical cross-section displaced at a substantial angle from the first intermediate portion with a (circular) cylindrical portion 20 (FIG. 8) between the elliptical portions. The rotation or displacement of one elliptical portion relative to the other may be any selected angular amount depending on the desired angular separation of the inlet and outlet on the tube shell described below. The size of the angle depends on the installation. The angle permits the assembly to be located where the inlet comes in on one side and the outlet is angularly displaced to position the outlet away from walls or other obstructions. FIG. 8 illustrates the product obtained, i.e., tube 16*a*, which has cylindrical ends 17 and 18 and a cylindrical central portion 20 and elliptical intermediate portions 19 and 21 (FIGS. 8–10**) having their major axes offset 90° from each other.

Figure 4:
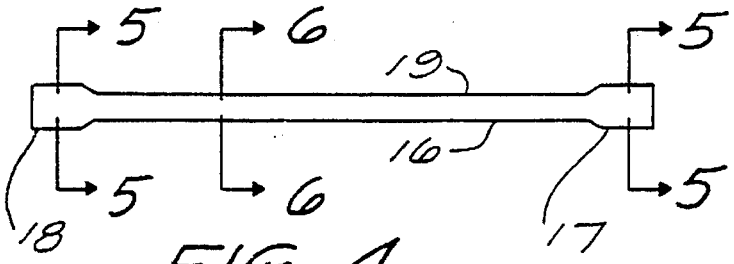
FIG. 4 is a view in elevation of a tube having cylindrical ends and an intermediate portion of elliptical cross section produced according to the process of FIG. 3.
Figure 5:
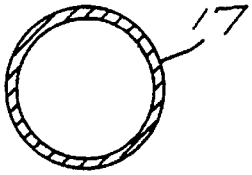
FIG. 5 is a view in cross section taken on the line 5—5 of FIG. 4 or FIG. 8 of the cylindrical end of the tube.

The tubes produced as shown in FIGS. 4 and 8 are used in the assembly of a tube and shell heat exchanger as described below. The spacing of tubes in the heat exchange shell is in accordance with TEMA (Tubular Exchanger Manufacturers Association) mechanical standards Class RCB. Tubes may be assembled in triangular, rotated triangular, square or rotated square pattern as illustrated in the Standards of the Tubular Exchanger Manufacturers Association. Minimum spacing, i.e., minimum center to center distance, is generally 1.25 times the O.D. of the tubes.

Figure 13:
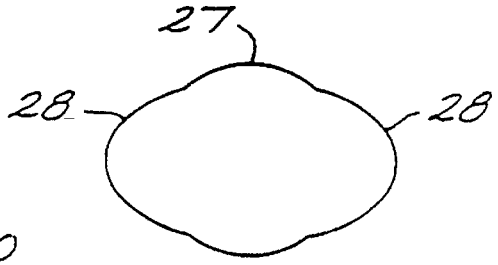
FIG. 13 is a detail view of one of the tube-receiving openings or holes in the baffle plates shown in FIG. 12 for receiving the tube shown in FIGS. 4–7.

A circular tube sheet 22 has circular holes or apertures 23 sized to receive the cylindrical ends 17 or 18 of tubes 16 and holes or apertures **23*a* sized to support tie rods and spacer members as described below. A circular disk-shaped baffle plate 24, having an O.D. which is smaller than the tube plate 22 by at least the wall thickness of the heat exchange shell, has an fiat edge 25 cut or formed along a chord of the disk. Baffle plates 24 have holes or apertures 26 shaped to allow tubes 16 to pass through and holes or apertures 26*a* having the same size as holes 23*a* in tube sheet 22. An enlarged detail of hole 26 is shown in FIG. 13 having a shape configured to pass the embodiment of tube 16 shown in FIGS. 4 and 7. Circular portions 27 of hole 26*a* are shaped to pass the circular portion 17, 18 and elliptical portions 28 are shaped to pass elliptical portions 19 of tube 16 shown in FIGS. 4 and 7**.

Figure 14:
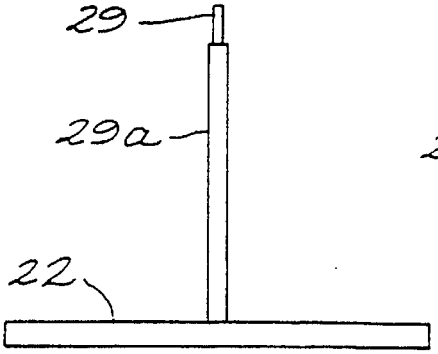
FIG. 14 is a view in elevation of the tube sheet of FIG. 11 with tie rods and spacers installed.
Figure 15:
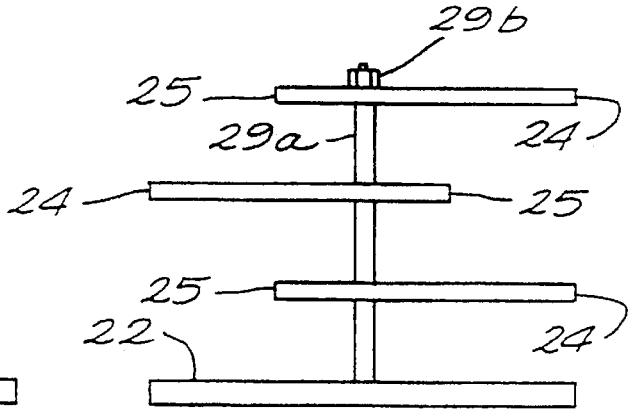
FIG. 15 is a view in elevation of the tube sheet of FIG. 11 with tie rods and spacers installed and the baffle plates of FIG. 12 positioned thereon.
Figure 16:
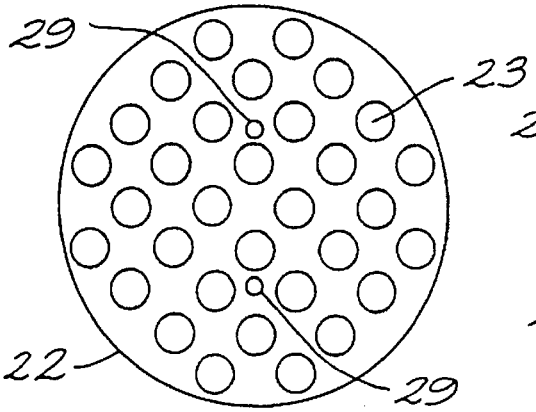
FIG. 16 is a plan view of the tube sheet of FIG. 11 with tie rods and spacers installed as in FIG. 14.
Figure 17:
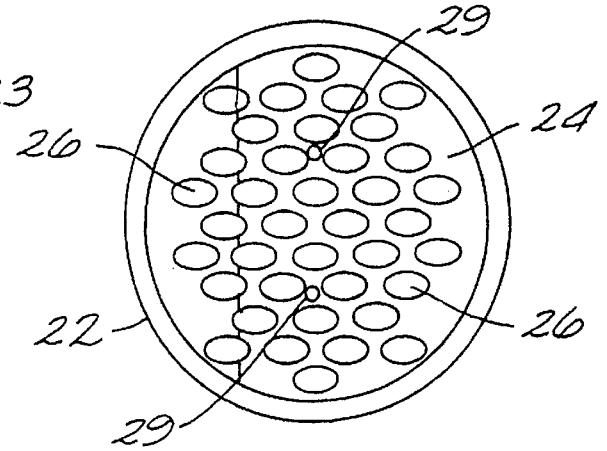
FIG. 17 is a plan view of the tube sheet of FIG. 11 with tie rods and spacers installed as in FIG. 14 and the baffle plates of FIG. 12 positioned as in FIG. 15.

The first assembly step is shown in FIG. 14. Two or more tie rods 29 are positioned in openings **23*a* in a first tube sheet (FIGS. 14 and 16) and are shorter than the tubes that are to be installed. Tie rods 29 are preferable threaded on each end to permit one end to be threaded into the first tube sheet 22 and the other end to have a nut threaded thereon to secure the tube bundle together. A first spacer tube 29*a* is fitted over each of the tie rods 29 to set the position of the first baffle plate 24. Next, the one of the baffle plates 24 is positioned on tube 29*a* which aligns spacer tube holes 26 with the holes 23 in tube sheet 22. Next, another set of spacer tubes 29*a* are positioned on tie rods 29 abutting the first baffle plate 24 and setting the distance to the next baffle plate 24. A second one of the baffle plates 24 is then positioned with its holes 26*a* over tie rods 29 in a reversed position and the assembly continued in the same manner for as many baffle plates as are desired or needed, with successive baffle plates 24 having their fiat edges 25 alternating (FIG. 15), i.e., 180° apart. This procedure can be continued for as many baffle plates as are required in the heat exchange assembly. In this case only three baffle plates 24** are used for ease of illustration.

Figure 18:
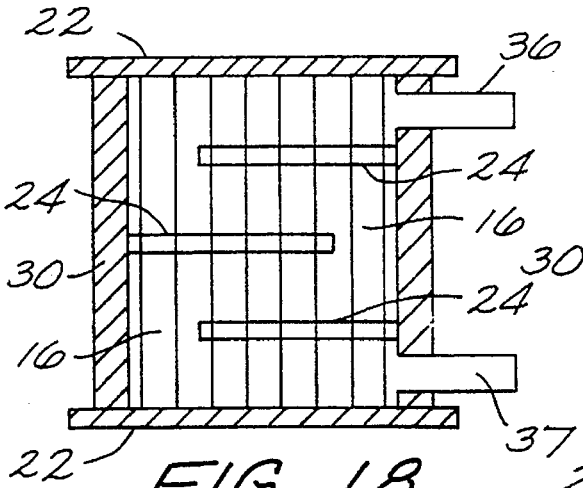
FIG. 18 is a view in elevation in which the tube sheet, tie rods, spacers, baffle plates and tube assembly has been installed in the shell and the second tube sheet closes the other end of the tube, where the inlet and outlet openings are on the same side.

After the last of the baffle plates 24 is installed, nut **29*b* is screwed on the upper end of tie rod 29 and tightened to lock the tube sheet, tie rods, spacers and baffle plates together as a tube assembly. The ends of tubes 16 are successively fed through the aligned holes 26 until the one cylindrical end 18 of each tube is inserted into the aligned hole 23 in the first tube sheet 22. This is repeated until tubes have been inserted through all of the holes 26 in the baffle plates 24 and the lower (as viewed in FIG. 18) ends fill all of the holes 23 in the lower tube sheet 22**.

Then the assembly with the tubes installed is placed inside a heat exchange shell 30 (of appropriate material, e.g., steel, stainless steel, aluminum or copper or copper alloys, bronze, brass or plastic) with the other ends of tubes 16 exposed and shell 30 abutting the lower tube plate 22. The alignment of the baffle plates 24 is such that their circular edges fit the inner surface (I.D.) of shell 30 as tightly as possible while allowing for assembly. A second or upper tube sheet 22 is positioned with its holes 23 over the upper ends of tubes 16 and abutting the upper end of shell 30. The upper cylindrical (circular) portions are secured (e.g, rolled, welded, soldered or brazed) in holes 23. Upper and lower tube sheets 22 are secured (e.g., by welding, soldering or brazing) to the ends of shell 30.

Figure 19:
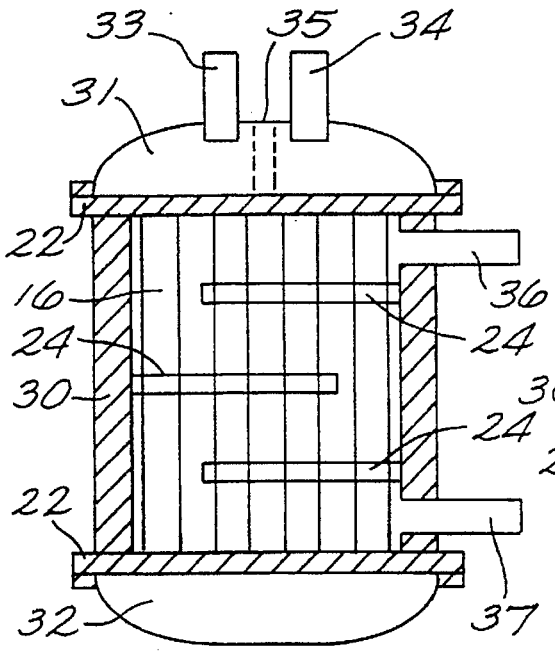
FIG. 19 shows a further step in the assembly of the tubing into a shell in which the assembly shown in FIG. 18 has headers positioned and secured on opposite ends.

Dished headers 31 and 32 (FIG. 19) are then secured (by nuts and bolts, welding, soldering or brazing) to the upper and lower tube plates 22. Headers 31 and 32 may also be secured by a typical flanged connection using bolts through aligned holes in the periphery of plates 22 and heaters 31 and 32 with suitable gaskets between the tube plates and headers. This construction is not shown but is conventional in tube and shell heat exchangers. Header 31 has an inlet tube 33 and outlet tube 34 and internal wall 35. Shell 30 has an inlet tube 36 and outlet tube 37 (FIG. 19) on the same side. In the operation of this embodiment, one fluid (liquid or gas) enters through inlet 33 and flows through the tubes 16 opening from the inlet side of wall 35 to the chamber formed by return header 32 and returns through the tubes 16 opening into the outlet side of wall 35 and out through outlet 34. The other fluid (gas or liquid) enters through inlet tube 36, flows circuitously around baffle plates 24 and exits through outlet tube 37 on the same side of the shell 30.

ANOTHER EMBODIMENT

Figure 20:
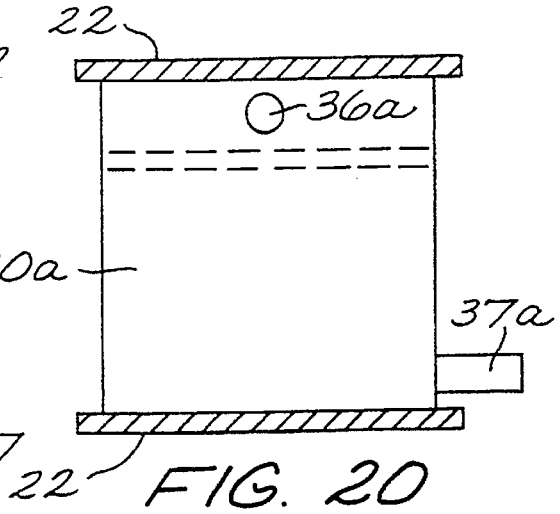
FIG. 20 shows another embodiment in which the tube sheet, tie rods, spacers and baffle plates and tube assembly has been installed in tube shell and the second tube sheet closes the other end of the shell, where the shell has inlet and outlet openings spaced angularly apart.
Figure 21:
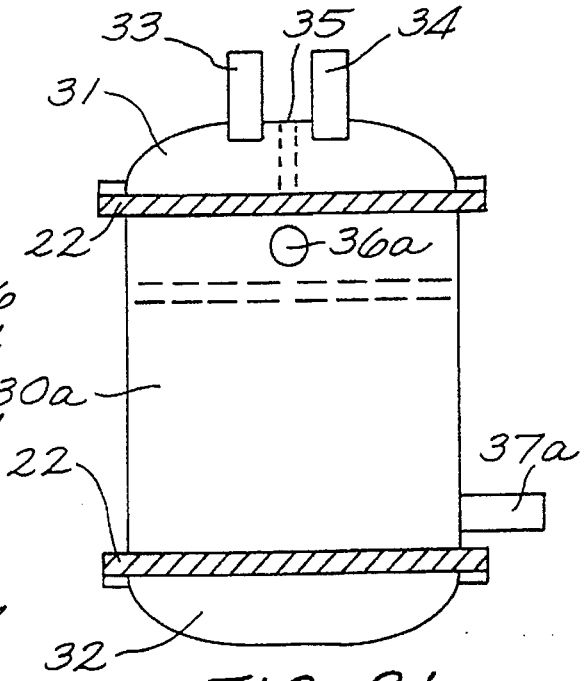
FIG. 21 shows a further step in the assembly of the tubing into a shell in which the assembly shown in FIG. 20 has headers positioned and secured on opposite ends.

In another embodiment, tubes 16 are used to produce the heat exchanger assembly shown in FIGS. 20 and 21. A modified procedure is followed.

The first assembly step is shown in FIG. 14. At least two tie rods 29 are positioned in openings **23*a* in a first tube sheet (FIGS. 14 and 16) and are shorter than the tubes that are to be installed. Tie rods 29 are preferable threaded on each end to permit one end to be threaded into the first tube sheet 22 and the other end to have a nut threaded thereon to secure the tube bundle together. A first spacer tube 29*a* is fitted over each of the tie rods 29 to set the position of the first baffle plate 24. Next, the one of the baffle plates 24 is positioned on spacer tube 29*a* which aligns tube holes 26 with the holes 23 in tube sheet 22. Next, another set of spacer tubes 29*a* are positioned on tie rods 29 abutting the first baffle plate 24 and setting the distance to the next baffle plate 24. A second One of the baffle plates 24 is then positioned with its holes 26*a* over tie rods 29 in a reversed position and the assembly continued in the same manner for as many baffle plates as are desired or needed, with successive baffle plates 24 having their flat edges 25 alternating (FIG. 15), i.e., 180° apart. This procedure can be continued for as many baffle plates as are required in the heat exchange assembly. In this case only three baffle plates 24 are used for ease of illustration. The last of the baffle plates 24, however, has its edge 25 displaced to cause flow over the angularly displaced elliptical portion toward the angularly displaced outlet. After the last of the baffle plates 24 is installed, nut 29*b* is screwed on the upper end of tie rod 29** and tightened to lock the tube sheet, tie rods, spacers and baffle plates together as a tube assembly.

In this embodiment, the tubes 16 of FIG. 8 are used. The ends of tubes **16*a* are successively fed through the aligned holes 26 until the cylindrical end 17, below elliptical portion 21, of each tube is inserted into the aligned hole 23 in the first tube sheet 22. This is repeated until tubes have been inserted through all of the holes 26 in the baffle plates 24 and the lower (as viewed in FIG. 18) ends fill all of the holes 23 in the lower tube sheet 22. Then the assembly with the tubes 16*a* installed is placed inside a heat exchange shell 30 (of appropriate material, e.g., steel, stainless steel, aluminum or copper or copper alloys, bronze, brass or plastic) with the other ends of tubes 16 exposed and shell 30 abutting the lower tube plate 22. The alignment of the baffle plates 24 is such that their circular edges fit the inner surface (I.D.) of shell 30 as tight as possible while allowing for assembly. A second or upper tube sheet 22 is positioned with its holes 23 over the upper ends of tubes 16 and abutting the upper end of shell 30 and the lower and upper cylindrical (circular) portions secured (e.g., rolled, welded, soldered or brazed) in holes 23. Upper and lower tube sheets 22 are secured (e.g., welding, soldering or brazing) to the ends of shell 30**.

Closure members, e.g., dished headers 31 and 32 (FIG. 21) are then secured (by nuts and bolts, welding, soldering or brazing) to the upper and lower tube plates 22. Headers 31 and 32 may also be secured by a typical flanged connection using bolts through aligned holes in the periphery of plates 22 and heaters 31 and 32 with suitable gaskets between the tube plates and headers. This construction is not shown but is conventional in tube and shell heat exchangers. Header 31 has an inlet tube 33 and outlet tube 34 and internal wall 35. Shell **30*a* has an inlet tube 36*a* and outlet tube 37*a* (FIGS. 20 and 21) spaced 90° (or other suitable angle) apart around the circumference of the shell which are aligned with the major axes of the elliptical portions 19 and 21, respectively. In the operation of this embodiment, one fluid (liquid or gas) enters through inlet 33 and flows through the tubes 16 opening from the inlet side of wall 35 to the chamber formed by return header 32 and returns through the tubes 16 opening into the outlet side of wall 35 and out through outlet 34. The other fluid (gas or liquid) enters through inlet tube 36*a*, flows circuitously around baffle plates 24 and exits through outlet tube 37*a* at a point 90° (or other suitable angle) from inlet tube 36*a* on the shell 30**.

A FURTHER EMBODIMENT

Figure 22:
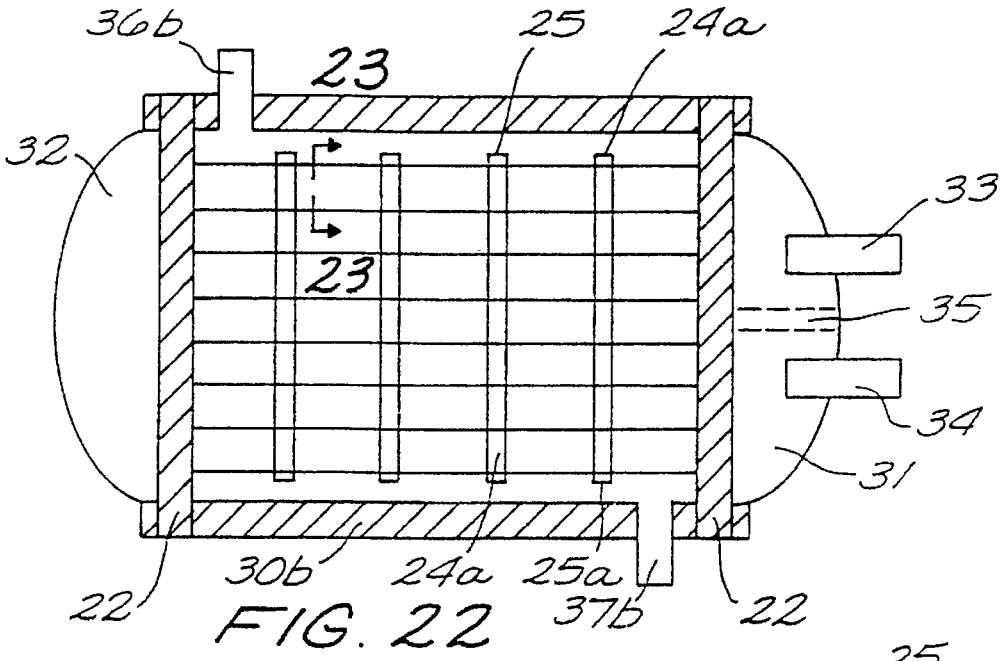
FIG. 22 shows a further step in the assembly of the tubing into a shell for a condenser in which the assembly has headers positioned and secured on opposite ends and the shell has gas inlet and liquid outlet openings on upper and lower sides thereof.
Figure 23:
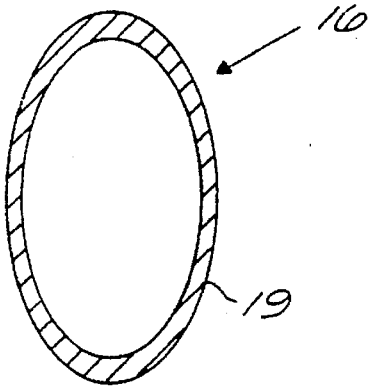
FIG. 23 is a cross section of one of the heat exchange tubes taken on the line 23—23 of FIG. 22.
Figure 24:
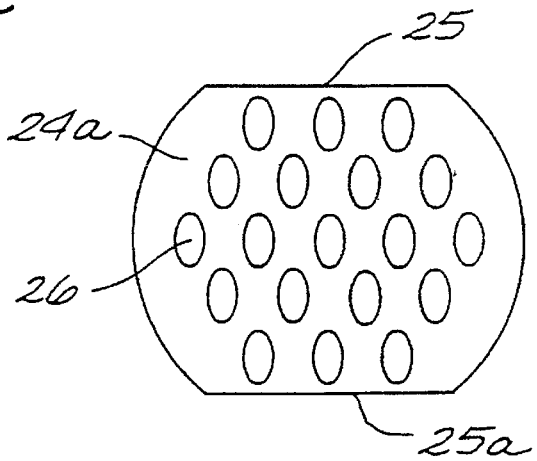
FIG. 24 is a view in elevation of one of the baffle plates in the embodiment of FIG. 22.

A further embodiment (vapor condenser or separator) is shown in FIGS. 22–24. This embodiment differs from the embodiment of FIGS. 18 and 19 in that a modified baffle plate is used (FIG. 24) and the inlet and outlet tubes to the shell are on opposite sides of the shell (FIG. 22).

A circular tube plate 22 has circular holes or apertures 23 sized to receive the cylindrical ends 17 or 18 of tubes 16 and holes or apertures **23*a* sized to receive tie rods as described below. A circular disk-shaped baffle plate 24*a*, having an O.D. smaller than tube plate 22 by at least the wall thickness of the heat exchange shell, has flat edges 25 and 25*a* cut or formed along a chord of the disk on opposite sides thereof. Baffle plates 24*a* have holes or apertures 26 shaped to allow tubes 16 to pass through and holes or apertures 26*a* having the same size as holes 23*a* in tube sheet 22. An enlarged detail of hole 26 is shown in FIG. 13 having a shape configured to pass the embodiment of tube 16** shown in FIGS. 4, 7 and 23. Circular portions 27 of hole 26*a* are shaped to pass the circular portion 17, 18 and elliptical portions 28 are shaped to pass elliptical portions 19 of tube 16 shown in FIGS. 4, 7 and 23.

The first assembly step is shown in FIG. 14. At least two tie rods 29 are positioned in openings 23*a* in a first tube sheet (FIGS. 14 and 16) and are shorter than tubes that are to be installed. Tie rods 29 are preferable threaded on each end to permit one end to be threaded into the first tube sheet 22 and the other end to have a nut threaded thereon to secure the tube bundle together. A first spacer tube 29*a* is fitted over each of the tie rods 29 to set the position of the first baffle plate 24. Next, the one of the baffle plates 24 is positioned on tube spacer 29*a* which aligns tube holes 26 with the holes 23 in tube sheet 22. Next, another set of spacer tubes 29*a* are positioned on tie rods 29 abutting the first baffle plate 24 and setting the distance to the next baffle plate 24. A second one of the baffle plates 24 is then positioned with its holes 26*a* over tie rods 29 in alignment with the first baffle plate and the assembly continued in the same manner for as many baffle plates as are desired or needed, with successive baffle plates 24 having their flat edges 25 aligned. This procedure can be continued for as many baffle plates as are required in the heat exchange assembly. In this case only four baffle plates 24a are used for ease of illustration.

After the last of the baffle plates 24*a* is installed, nut 29*b* is screwed on the upper end of tie rod 29 and tightened to lock the tube sheet, tie rods, spacers and baffle plates together as an assembly. The ends of tubes 16 are successively fed through the aligned holes 26 until the one cylindrical end 18 of each tube is inserted into the aligned hole 23 in the first tube sheet 22. This is repeated until tubes have been inserted through all of the holes 26 in the baffle plates 24 and the lower (as viewed in FIG. 18) ends fill all of the holes 23 in the lower tube sheet 22.

Then the assembly with the tubes installed is placed inside a heat exchange shell 30*b* (of appropriate material, e.g., steel, stainless steel, aluminum or copper or copper alloys, bronze, brass or plastic) with the other ends of tubes 16 exposed and shell 30 abutting the lower tube plate 22. The alignment of the baffle plates 24 is such that their circular edges fit the inner surface (I.D.) of shell 30 as tight as possible while allowing for assembly. A second or upper tube sheet 22 is positioned with its holes 23 over the upper ends of tubes 16 and abutting the upper end of shell 30*b* and the lower and upper cylindrical (circular) portions secured (e.g., rolled, welded, soldered or brazed) in holes 23. Upper and lower tube sheets 22 are secured (e.g., welding, soldering or brazing) to the ends of shell 30*b*.

Closure members, e.g., dished headers 31 and 32 (FIG. 22), are then secured (by nuts and bolts, welding, soldering or brazing) to the upper and lower tube plates 22. Headers 31 and 32 may also be secured by a typical flanged connection using bolts through aligned holes in the periphery of plates 22 and heaters 31 and 32 with suitable gaskets between the tube plates and headers. This construction is not shown but is conventional in tube and shell heat exchangers.

Header 31 has an inlet tube 33 and outlet tube 34 and internal wall 35. Shell 30*b* has an inlet tube 36*b* at the top and outlet tube 37*b* at the bottom (FIG. 22). In the operation of this embodiment, cooling fluid (liquid or gas) enters through inlet 33 and flows through the tubes 16 opening from the inlet side of wall 35 to the chamber formed by return header 32 and returns through the tubes 16 opening into the outlet side of wall 35 and out through outlet 34. A gas (vapor) enters through inlet tube 36*b*, spreads across the top of shell 30*b* and flows around baffle plates 24 through the bank of tubes 16, condensing to a liquid which exits through outlet tube 37*b* on the bottom of the shell 30*b*.

ANOTHER EMBODIMENT

Figure 25:
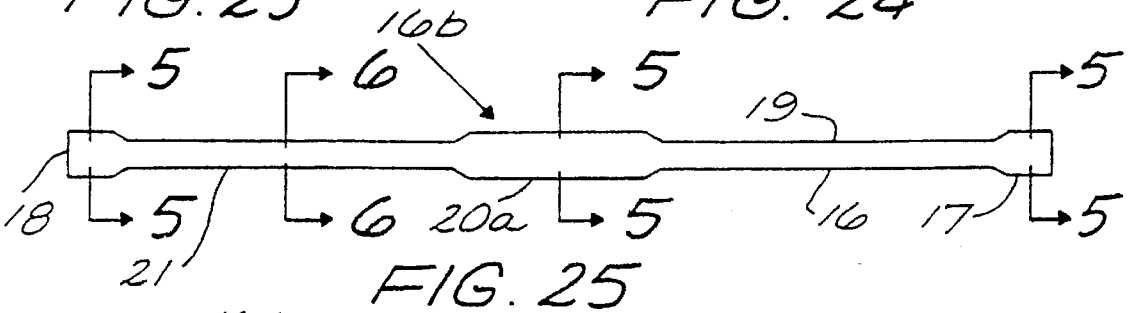
FIG. 25 is a view in elevation of a tube having cylindrical ends, and separate intermediate portions of elliptical cross section having aligned major axes and a mid-portion of cylindrical shape of the same size as the ends.
Figure 26:
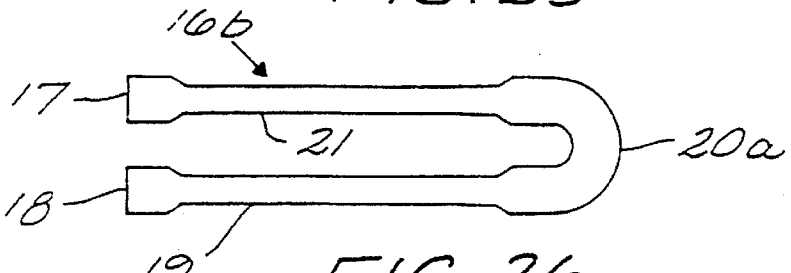
FIG. 26 is a view in elevation of the tube shown in FIG. 25 bent 180° at the mid-portion to form a U-shaped heat exchange tube.

In FIGS. 25 and 26, there is shown a further embodiment of the invention as applied to U-tubes for use in tube and shell heat exchangers.

In an alternate embodiment of tube formation (see FIG. 25), tube 16*b* is deformed for part of its length, e.g., about one half the length, the deforming rolls 10 and 11 released, the tube advanced to leave an undeformed portion 20*a* and the rollers 10 and 11 then compressed to produce a second intermediate portion of elliptical cross section aligned with the first intermediate potion. FIG. 25 illustrates the product, tube 16*b*, thus obtained, which has cylindrical ends 17 and 18 and a cylindrical central portion 20*a* and elliptical intermediate portions 19 and 21 having their major axes aligned with each other. In the next step, the tube 16*b* is bent 80° at 20*a* so that the elliptical portions 19 and 21 are parallel and ends 17 and 18 are closely spaced.

In this embodiment, only one tube sheet is used. A circular tube sheet 22 has circular holes or apertures 23 sized to receive the cylindrical ends 17 or 18 of tubes 16 and holes or apertures 23*a* sized to support tie rods and spacer members as described below. A circular disk-shaped baffle plate 24, having an O.D. which is smaller than the tube plate 22 by at least the wall thickness of the heat exchange shell, has an flat edge 25 cut or formed along a chord of the disk. Baffle plates 24 have holes or apertures 26 shaped to allow tubes 16 to pass through and holes or apertures 26*a* having the same size as holes 23*a* in tube sheet 22. An enlarged detail of hole 26 is shown in FIG. 13 having a shape configured to pass the embodiment of tube 16 shown in FIGS. 4 and 7. Circular portions 27 of hole 26*a* are shaped to pass the circular portion 17, 18 and elliptical portions 28 are shaped to pass elliptical portions 19 of tube 16 shown in FIGS. 4 and 7.

The first assembly step is shown in FIG. 14. Two or more tie rods 29 are positioned in openings 23*a* in a first tube sheet (FIGS. 14 and 16) and are shorter than the tubes that are to be installed. Tie rods 29 are preferable threaded on each end to permit one end to be threaded into the first tube sheet 22 and the other end to have a nut threaded thereon to secure the tube bundle together. A first spacer tube 29*a* is fitted over each of the tie rods 29 to set the position of the first baffle plate 24. Next, the one of the baffle plates 24 is positioned on spacer tube 29*a* which aligns tube holes 26 with the holes 23 in tube sheet 22. Next, another set of spacer tubes 29*a* are positioned on tie rods 29 abutting the first baffle plate 24 and setting the distance to the next baffle plate 24. A second one of the baffle plates 24 is then positioned with its holes 26*a* over tie rods 29 in a reversed position and the assembly continued in the same manner for as many baffle plates as are desired or needed, with successive baffle plates 24 having their flat edges 25 alternating (FIG. 15), i.e., 180° apart. This procedure can be continued for as many baffle plates as are required in the heat exchange assembly. In this case only three baffle plates 24 are used for ease of illustration.

After the last of the baffle plates 24 is installed, nut 29*b* is screwed on the upper end of tie rod 29 and tightened to lock the tube sheet, tie rods, spacers and baffle plates together as an assembly. The ends 17 and 18 of U-tubes 16*b* are successively fed through the aligned holes 26 until the one cylindrical end 18 of each tube is inserted into the aligned hole 23 in the first tube sheet 22. This is repeated until U-tubes have been inserted through all of the holes 26 in the baffle plates 24 and the lower (as viewed in FIG. 18) ends fill all of the holes 23 in the lower tube sheet 22. Tubes **16*b* are secured (e.g., by rolling, welding, soldering or brazing) in holes 23 of tube sheet 22**.

After the all of the tubes **16*b* secured (e.g., rolled, welded, soldered or brazed) in place in holes 23 in the single tube sheet 22, the tube bundle, including the installed tubes 16, is placed inside a heat exchange shell 30 (of appropriate material, e.g., steel, stainless steel, aluminum or copper or copper alloys, bronze, brass or plastic) with the other ends of tubes 16 exposed and shell 30 abutting the lower tube plate 22. The alignment of the baffle plates 24 is such that their circular edges fit the inner surface (I.D.) of shell 30 as tight as possible while allowing for assembly. The upper, rebent end portions 20*a* of tubes 16a are not covered by a tube sheet as in the other embodiments. The one tube sheet 22 is secured (e.g., by rolling, welding, soldering or brazing) to one end of shell 30. Suitable headers of any appropriate design may be installed on opposite ends of shell 30**.

A FURTHER EMBODIMENT

FIG. 27 illustrates a further embodiment of the invention in which the inlet and outlet to the heat exchange tubes are on opposite ends of the tube and shell heat exchanger. In this embodiment, headers 31 and 32 have inlet 31 and outlet 32 on opposite ends of the shell 30 (or **30*a* or 30*b*). This embodiment allows the tubes 16** to have through flow rather than a reverse flow at one end of the shell.

A FURTHER EMBODIMENT

FIG. 28 and 29 illustrate a further embodiment of the invention in which the shell is assembled in sections. A short section of shell 130 (FIG. 28) has one of the outlet or inlet openings 36, 37 therein. This section 130 is then secured (e.g. welding, soldering or brazing) to tube sheet 22 and the tie rods, spacer tubes and baffle plates installed as previously described. A similar short shell section is secured to the other tube sheet for use at the other end of the assembly. Then, after the heat exchange tubes are secured in place, the main length of shell 30 is secured (e.g., welding, soldering or brazing) to short section 130 and the other short section 130 and second tube sheet 22 are installed with the tubes in the tube sheet boles and the short section 130 secured (e.g., welding, soldering or brazing) to the other end of the main shell section.

While this invention has been described fully and completely with special emphasis on certain preferred embodiments, it should be understood that within the scope of the appended claims the invention may be practiced otherwise than as specifically described.

I claim:

1. A method of producing a heat exchanger having improved flow and heat exchange properties which comprises:

providing a hollow tube, cylindrical along its entire length, then deforming a predetermined length of an intermediate portion of said tube into a substantially elliptical cross section symmetrical with the center line of said tube without deforming the ends of the tube from their cylindrical shape, providing at least one tube sheet having a predetermined number of circular holes having a diameter substantially the same as the O.D. of said tube cylindrical ends, and securing said tube cylindrical ends in said tube sheet circular holes.

2. A method according to claim 1 including providing a pair of reciprocally movable compression rollers, each of said rollers having a peripheral surface of a selected concave shape, moving said rollers together to press said concave surfaces against said tube at a point spaced from the end of the tube and linearly along said tube to compress and deform the tube to produce said symmetrically elliptical cross section and moving said rollers away from said tube after forming said symmetrical elliptical cross section.

3. A method according to claim 2 including moving said rollers together to press said concave surfaces against and linearly along one portion of said tube, moving said rollers away from said tube and a selected distance along said tube, and then moving said rollers together to press said concave surfaces against and linearly along another portion of said tube, to produce linearly spaced portions of symmetrically elliptical cross section, and finally moving said rollers away from said tube.

4. A method according to claim 3 further including bending said intermediate portion 180° to produce a U-shaped tube having adjacently positioned cylindrical ends and portions of elliptical cross section.

5. A method according to claim 3 including rotating said tube for a predetermined angle after moving said rollers away from said tube and before being moving said rollers together against said another portion of said tube, to produce angularly offset linearly spaced symmetrically elliptical cross sections separated by an intermediate portion of cylindrical cross section.

6. A method according to claim 1 including providing two tube sheets, each having circular holes of the size of said cylindrical ends of said tubes and positioning and securing opposite cylindrical ends of said tubes in selected holes in each of said tube sheets.

7. A method according to claim 4 including providing only one tube sheet, having circular holes of the size of said cylindrical ends of said tubes and positioning and securing said adjacently positioned cylindrical ends of said tubes in selected holes in said tube sheet.

8. A method according to claim 2 further including providing baffle plates having holes sized and shaped to just pass the cylindrical ends and symmetrically elliptical cross section portions of said tubes having the same spacing as the holes in said tube sheet, supporting said baffle plates in spaced relation with said baffle plate holes aligned with said tube sheet holes, and inserting said tubes through said baffle plate holes and then securing said tube cylindrical ends in said tube sheet holes with said elliptical cross section tube portions being supported in said baffle plates.

9. A method according to claim 8 including supporting said baffle plates in spaced relation includes providing tie rods and spacer members, securing said tie rods in said tube sheet, placing a first set of spacer members over said tie rods, placing the first of said baffle plates over said tie rods abutting said first set of spacer members, repeating placing baffle plates and spacer members a predetermined number of times, and providing securing members and placing them on said tie rods to engage and lock said baffle plates in fixed relation as a heat exchange tube assembly.

10. A method according to claim 1 further including providing baffle plates having holes sized and shaped to just pass the cylindrical ends and symmetrically elliptical cross section portions of said tubes having the same spacing as the holes in said tube sheet, providing tie rods and spacer members, securing said tie rods in said tube sheet, placing a first set of spacer members over said tie rods, placing the first of said baffle plates over said tie rods abutting said first set of spacer members, repeating placing baffle plates and spacer members a predetermined number of times, providing securing members and placing them on said tie rods to engage and lock said baffle plates in fixed relation as a heat exchange tube assembly, inserting said tubes through said baffle plate holes and then securing said tube cylindrical ends in said tube sheet holes with said symmetrically elliptical cross section tube portions being positioned and supported in said baffle plates, providing a hollow heat exchange shell having an inlet and an outlet through the wall thereof, placing said shell over said heat exchange tube assembly, and securing one end of said shell to said tube sheet.

11. A method according to claim 10 including providing a second tube sheet having holes sized and spaced to receive the ends, placing said second tube sheet over the unsecured ends and abutting the end of said shell, and securing said second tube sheet and the unsecured ends of said tubes to said shell.

12. A method according to claim 10 in which said shell comprises at least a short portion and a long portion, securing said tube sheet to said short shell portion, and then securing said long shell portion to said short shell portion.

13. A method according to claim 11 in which said shell comprises two short portions and a long portion, securing one tube sheet to one short shell portion, securing the other tube sheet to the other short portion, and then securing said long shell portion to said short shell portions.

14. A method according to claim 10 including providing a plurality of header members, at least one of said headers having an inlet opening and at least one of said headers having an outlet opening, and securing one of said header members to one end of said shell and another of said header members to another end of said shell.

15. A method according to claim 7 including providing only one tube sheet, and providing baffle plates having holes sized and shaped to just pass the cylindrical ends and symmetrically elliptical cross section portions of said tubes having the same spacing as the holes in said tube sheet, supporting said baffle plates in spaced relation with said baffle plate holes aligned with said tube sheet holes, and inserting said tubes through said baffle plate holes and then securing said tube adjacently positioned cylindrical ends in said tube sheet holes with said elliptical cross section tube portions being supported in said baffle plates.

16. A method according to claim 15 including providing a hollow heat exchange shell having an inlet and an outlet through the wall thereof, placing said shell over said heat exchange tube assembly, securing one end of said shell and said tubes to said tube sheet, and providing end closure members and securing one to each end of said shell.

17. A method according to claim 5 further including providing baffle plates having holes sized and shaped to just pass the cylindrical ends and symmetrically elliptical cross section portions of said tubes having the same spacing as the holes in said tube sheet, supporting said baffle plates in spaced relation with said baffle plate holes aligned with said tube sheet holes, and inserting said tubes through said baffle plate holes and then securing said tube cylindrical ends in said tube sheet holes with said symmetrically elliptical cross section tube portions being supported in said baffle plates.

18. A method according to claim 17 including supporting said baffle plates in spaced relation by providing tie rods and spacer members, securing said tie rods in said tube sheet, placing a first set of spacer members over said tie rods, placing the first of said baffle plates over said tie rods abutting said first set of spacer members, repeating placing baffle plates and spacer members a predetermined number of times, providing securing members and placing them on said tie rods to engage and lock said baffle plates in fixed relation as a heat exchange tube assembly, and inserting said tubes through said baffle plate holes and then securing said tube cylindrical ends in said tube sheet holes with said first symmetrically elliptical cross section tube portions being supported in said baffle plates.

19. A method according to claim 18 including providing a hollow heat exchange shell having an inlet and an outlet through the wall thereof angularly spaced at substantially the same angular spacing as said symmetrically elliptical portions, placing said shell over said heat exchange tube assembly, and securing one end of said shell and the ends of said tubes to said tube sheet.

20. A method according to claim 19 including providing a second tube sheet having holes sized and spaced to receive the ends, placing said second tube sheet over the unsecured ends of said tubes and securing them therein, securing said second tube sheet and the other ends of said tubes to said shell, and providing header members and securing one to each end of said shell.

* * * * *